US009816315B1

(12) United States Patent
Price et al.

(10) Patent No.: US 9,816,315 B1
(45) Date of Patent: Nov. 14, 2017

(54) WINDOW WELL COVER

(71) Applicants: Wayne Price, Littleton, CO (US); Dann Papp, Littleton, CO (US)

(72) Inventors: Wayne Price, Littleton, CO (US); Dann Papp, Littleton, CO (US)

( * ) Notice: Subject to any disclaimer, the term of this patent is extended or adjusted under 35 U.S.C. 154(b) by 0 days.

(21) Appl. No.: 15/263,751

(22) Filed: Sep. 13, 2016

(51) Int. Cl.

| | |
|---|---|
| ***E04B 7/00*** | (2006.01) |
| ***E06B 9/02*** | (2006.01) |
| ***E06B 3/34*** | (2006.01) |
| *E04F 17/06* | (2006.01) |

(52) U.S. Cl.
CPC ..... *E06B 9/02* (2013.01); *E06B 3/34* (2013.01); *E04F 17/06* (2013.01)

(58) Field of Classification Search
CPC ..... E06B 9/02; E06B 3/34; E04F 17/06
USPC ..... 49/386, 387; 52/19, 20, 107
See application file for complete search history.

(56) References Cited

U.S. PATENT DOCUMENTS 4,903,455 A * 2/1990 Veazey ..... E04B 1/0046 52/73
5,339,579 A * 8/1994 Woodyer ..... E04F 17/06 29/897.32
6,321,491 B1 * 11/2001 DiMauro ..... E06B 5/01 52/107
D484,615 S 12/2003 Ecker
6,766,616 B2 * 7/2004 Richter ..... E04D 13/0354 49/1
6,799,395 B1 * 10/2004 Dabrowski ..... E02D 29/1418 49/366
6,810,629 B1 * 11/2004 Hughes ..... E06B 5/01 52/107
7,243,463 B1 * 7/2007 Lucero ..... E06B 9/02 49/463
7,356,968 B2 * 4/2008 Joyce ..... E06B 5/01 49/169
7,412,799 B1 * 8/2008 Aguirre ..... E06B 7/086 49/394
7,444,784 B2 * 11/2008 Brown ..... E06B 5/01 292/266
7,802,402 B2 * 9/2010 Skaggs ..... E02D 29/127 52/107
8,091,292 B1 * 1/2012 Jalbert ..... E04F 17/06 49/386
8,458,965 B1 6/2013 Rieger
2002/0144463 A1 * 10/2002 Liddell ..... E06B 9/02 49/57
2002/0162277 A1 * 11/2002 Foster ..... E06B 9/02 49/62

(Continued)

*Primary Examiner* — Jerry Redman
(74) *Attorney, Agent, or Firm* — Kyle A. Fletcher, Esq.

(57) ABSTRACT

The window well cover is a cover that is placed on top of the window well. The window well cover is a screened frame that prevents debris from falling into the window well but allows light to pass into the window well in order to provide natural light to enter cellar environments. The window well cover is fitted with a first door and a second door that allows access into the window well for maintenance purposes. The first door and the second door are secured with a locking latch when closed. The window well cover comprises a first door, a second door, a master panel, and a locking latch. The first door and the second door are mounted on the master panel. The locking latch secures the first door and the second door in the closed position.

19 Claims, 4 Drawing Sheets

(56) References Cited

U.S. PATENT DOCUMENTS

| | | | | |
|---|---|---|---|---|
| 2003/0097802 | A1* | 5/2003 | Kim | E04F 17/06 52/19 |
| 2006/0010792 | A1* | 1/2006 | Biggers | E06B 9/02 52/202 |
| 2006/0118356 | A1* | 6/2006 | Beeson | E06B 5/20 181/287 |
| 2008/0016780 | A1* | 1/2008 | McDougle | E05D 13/1253 49/387 |
| 2008/0034673 | A1 | 2/2008 | Tran | |
| 2011/0203194 | A1 | 8/2011 | Kelsch | |
| 2012/0174499 | A1* | 7/2012 | Siepel | E04F 17/06 52/107 |
| 2014/0298731 | A1* | 10/2014 | VanMeter | H02G 9/10 52/20 |

* cited by examiner

WINDOW WELL COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of finishing work for buildings, more specifically, an accessory for light shafts for cellars.

SUMMARY OF INVENTION

The window well cover is an accessory adapted for use with a window well. The window well cover is a cover that is placed on top of the window well. The window well cover is a screened frame that prevents debris from falling into the window well but allows light to pass into the window well in order to provide natural light to enter cellar environments. The window well cover is fitted with a first door and a second door that allows access into the window well for maintenance and security purposes. The first door and the second door are secured with a locking latch when closed.

These together with additional objects, features and advantages of the window well cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the window well cover in detail, it is to be understood that the window well cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the window well cover.

It is therefore important that the claims be regarded as including such equivalent construction insofar as they do not depart from the spirit and scope of the window well cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
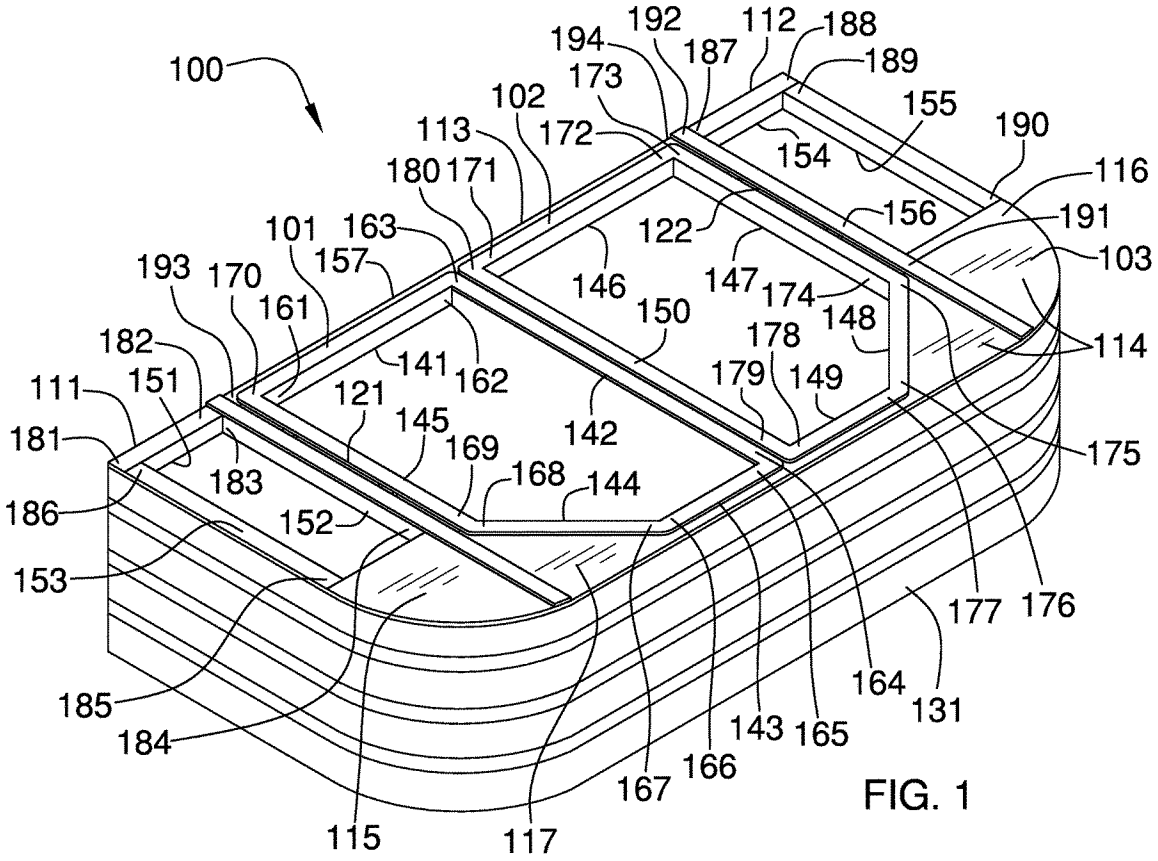
FIG. 1 is a perspective view of an embodiment of the disclosure without the mesh screening.
Figure 2:
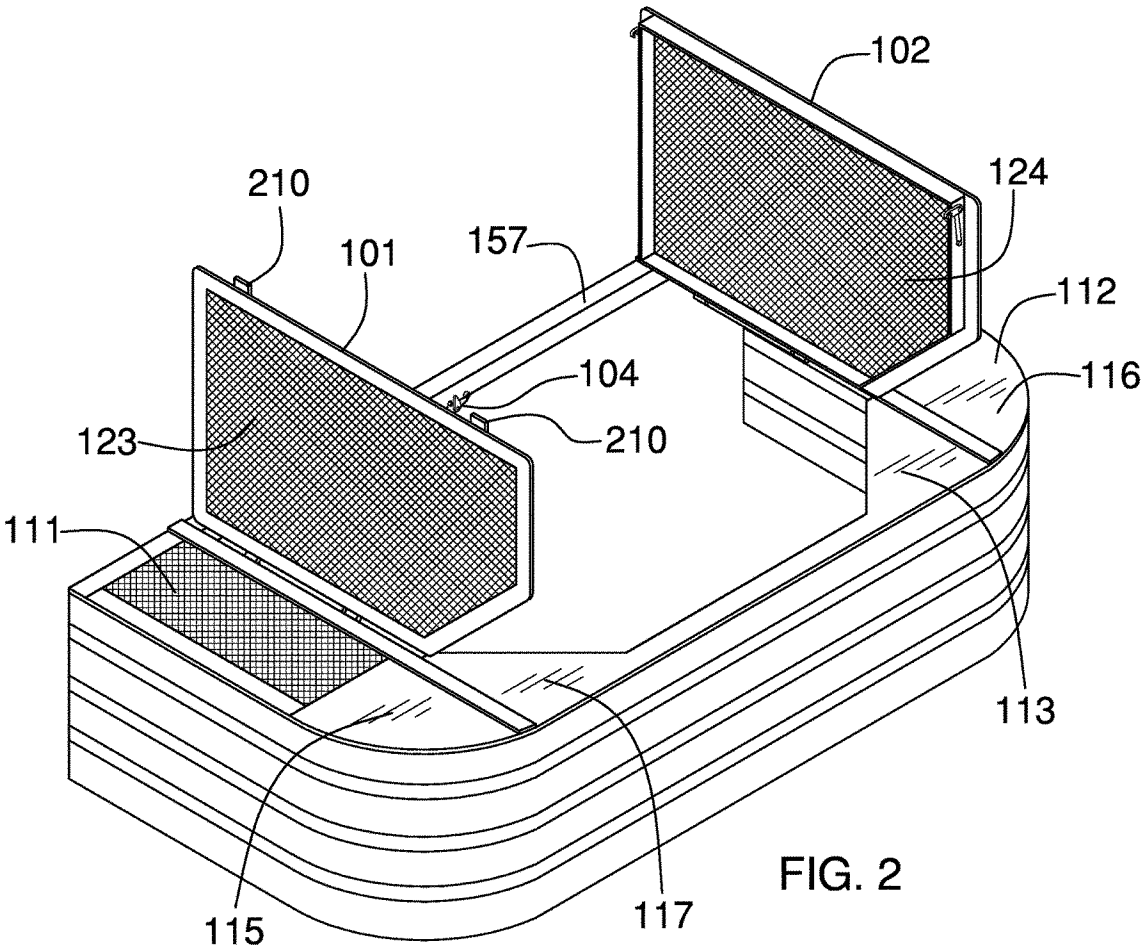
FIG. 2 is a perspective view of an embodiment of the disclosure.
Figure 3:
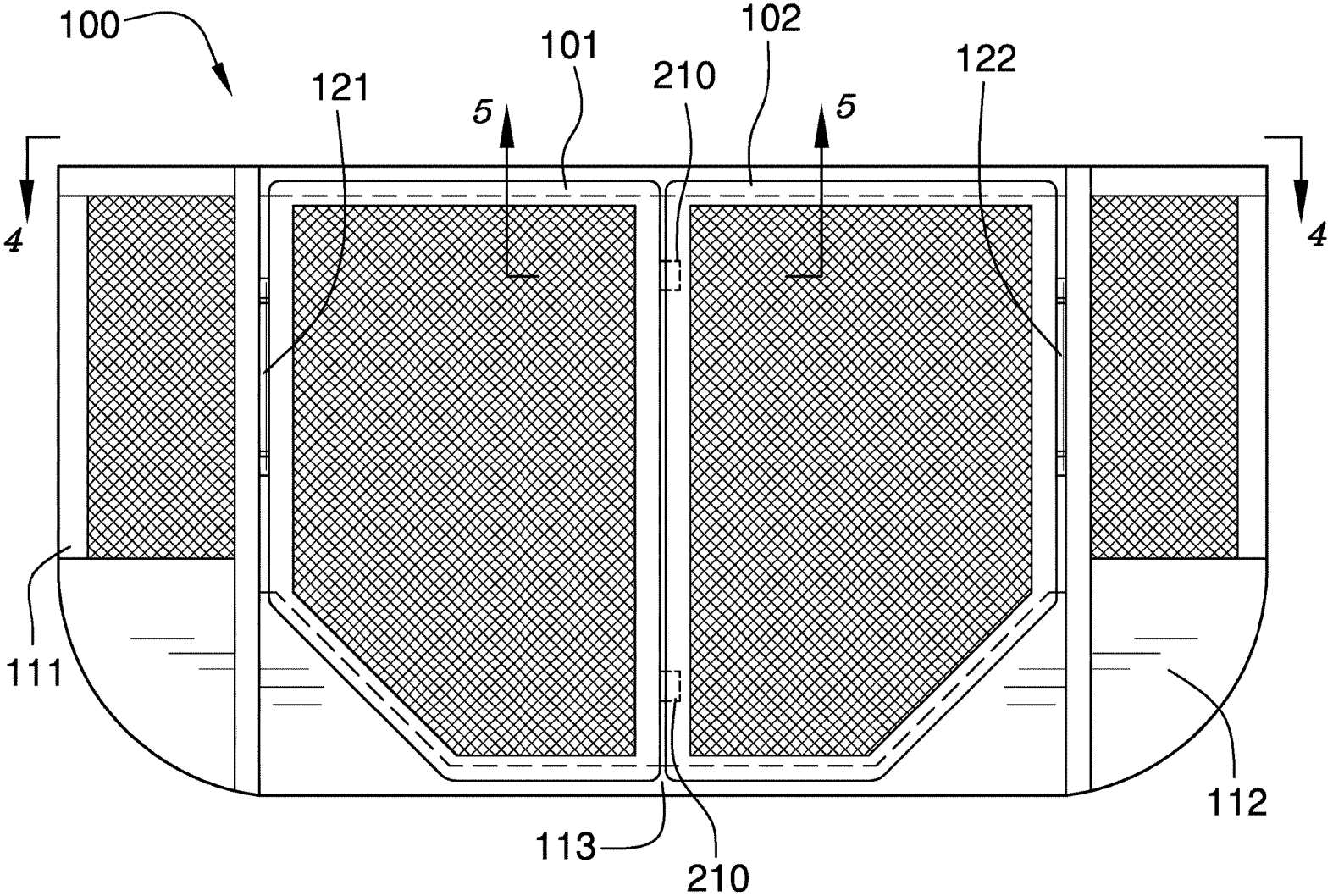
FIG. 3 is a top view of an embodiment of the disclosure.
Figure 4:
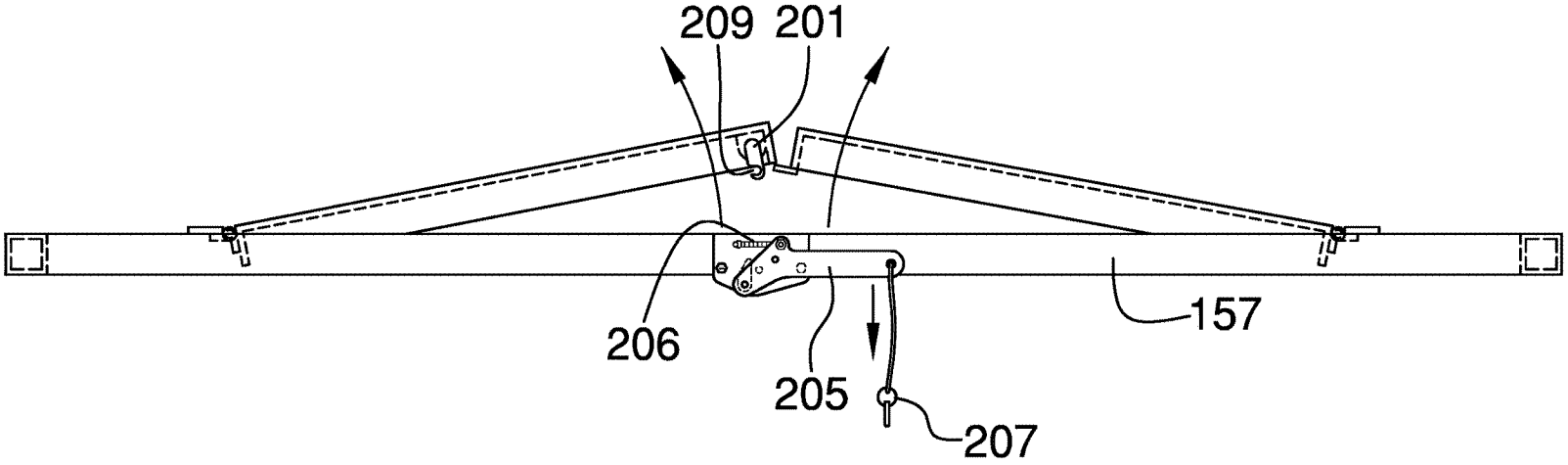
FIG. 4 is a rear view of an embodiment of the disclosure.
Figure 5:
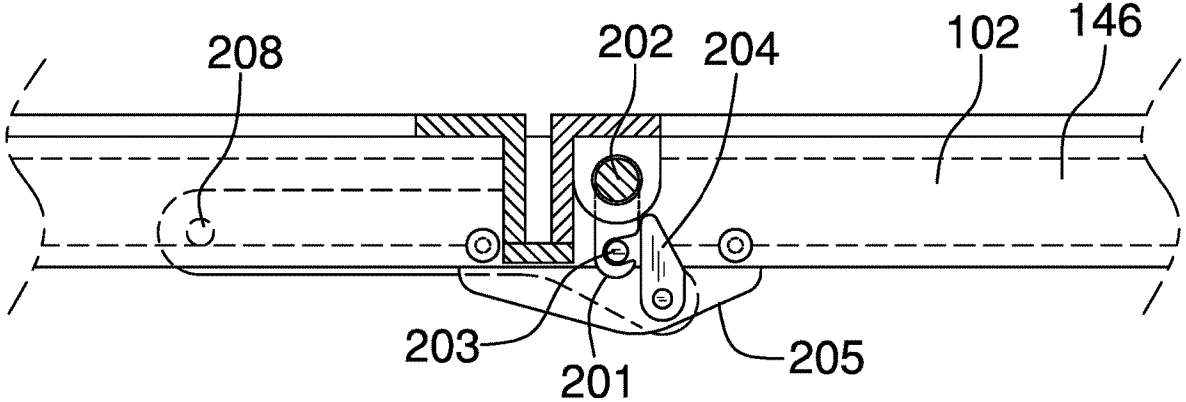
FIG. 5 is a cross-sectional view of an embodiment of the disclosure across 5-5 as shown in FIG. 3.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The window well cover 100 (hereinafter invention) comprises a first door 101, a second door 102, a master panel 103, and a locking latch 104. The first door 101 and the second door 102 are mounted on the master panel 103. The locking latch 104 secures the first door 101 and the second door 102 in a closed position. The invention 100 is an accessory adapted for use with a window well 131. The invention 100 is a cover that is placed on top of the window well 131. The invention 100 is a screened frame that prevents debris from falling into the window well 131 but allows light to pass into the window well 131 in order to provide natural light to enter cellar environments. The invention 100 is fitted with a first door 101 and a second door 102 that allows access into the window well 131 for maintenance purposes. The first door 101 and the second door 102 are secured with a locking latch 104 when closed.

The first door 101 comprises a first tube 141, a second tube 142, a third tube 143, a fourth tube 144, a fifth tube 145, a first hinge 121, and a first screen mesh 123. The first tube 141, the second tube 142, the third tube 143, the fourth tube 144, and the fifth tube 145 are assembled into a first rectilinear frame. The first door 101 is attached to the master panel 103 using the first hinge 121. As shown most clearly in FIG. 2, the first door 101 is covered with first screen mesh 123.

The second door 102 comprises a sixth tube 146, a seventh tube 147, an eighth tube 148, a ninth tube 149, a tenth tube 150, a second hinge 122, and a second screen mesh 124. The sixth tube 146, the seventh tube 147, an eighth tube 148, the ninth tube 149, and the tenth tube 150 are assembled into a second rectilinear frame. The second door 102 is attached to the master panel 103 using the second hinge 122. As shown most clearly in FIG. 2, the frame that forms the second door 102 is covered in a second screen mesh 124.

When installed on the master panel 103, the first door 101 and the second door 102 are mirror images of each other.

The master panel 103 comprises a first sidelight 111, a second sidelight 112 and a door panel 113, and a master transom 114. The master transom 114 is a metal plate. While the master transom 114 is formed as a single unit, for purposes of clarity, the master transom 114 is said to further comprise a first transom 115, a second transom 116, and a door transom 117. The use of the master transom 114 is for manufacturing purposes. By using plate metal, the invention 100 be built with a single design that can handle variations between window wells. This variation is handled by varying the form factor of the master transom 114 in such a manner that the perimeter of the invention 100 matches the perimeter of the window well 131 the invention 100 is mounted on. The first sidelight 111 further comprises an eleventh tube 151, a twelfth tube 152, a thirteenth tube 153, and the first transom 115. The second sidelight 112 further comprises a fourteenth tube 154, a fifteenth tube 155, a sixteenth tube 156, and the second transom 116. The door panel 113 further comprises a seventeenth tube 157 and the door transom 117. The first sidelight 111 and the second sidelight 112 are both attached to the door panel 113.

The locking latch 104 comprises a latch arm 201, a latch shaft 202, a latch post 203, a release bar 204, a release handle 205, a release spring 206, a lock pin 207, and a lock pin hole 208. As shown most clearly in FIGS. 4 and 5, the latch arm 201 is mounted on the sixth tube 146 of the second door 102 on the latch shaft 202 such that the latch arm 201 can rotate using the latch shaft 202 as a pivot. The latch arm 201 has further formed in it a notch 209. The notch 209 is designed to enclose the latch post 203. The latch post 203 is a cylindrical shaft that is attached to the seventeenth tube 157 of the master panel 103 such that when the latch arm 201 encloses the latch post 203 the second door 102 is locked in a closed position. The release handle 205 is a structure that is mounted on the seventeenth tube 157 of the master panel 103 such that the release handle 205 can be rotated around a pivot. The release bar 204 is attached to the release handle 205 such that when the release handle 205 is rotated the release bar 204 will rotate in a manner that pushes the latch arm 201 away from the latch post 203 thereby allowing the second door 102 to open by rotating away from the window well 131. The release handle 205 is further fitted with a release spring 206. The release spring 206 is attached to the seventeenth tube 157 such that the release spring 206 will return the release handle 205 to its original position after use. For safety and security purposes, a lock pin 207 and a lock pin hole 208 are formed within the locking latch 104 to prevent vibrations or other external forces from inadvertently opening the locking latch 104. As shown most clearly in FIG. 2, the second tube 142 of the first door 101 is further fitted with a plurality of interlocking panels 210. The purpose of the plurality of interlocking panels 210 is to interact with tenth tube 150 of the second door 102 such that when the second door 102 is locked in position with the locking latch 104, the plurality of interlocking panels 210 will prevent the first door 101 from opening. Methods to build a locking latch 104 as described in this disclosure are well known and documented in the mechanical arts.

The first tube 141 is a readily and commercially available square metal tube. The second tube 142 is a readily and commercially available square metal tube. The third tube 143 is a readily and commercially available square metal tube. The fourth tube 144 is a readily and commercially available square metal tube. The fifth tube 145 is a readily and commercially available square metal tube. The sixth tube 146 is a readily and commercially available square metal tube. The seventh tube 147 is a readily and commercially available square metal tube. The eighth tube 148 is a readily and commercially available square metal tube. The ninth tube 149 is a readily and commercially available square metal tube. The tenth tube 150 is a readily and commercially available square metal tube. The eleventh tube 151 is a readily and commercially available square metal tube. The twelfth tube 152 is a readily and commercially available square metal tube. The thirteenth tube 153 is a readily and commercially available square metal tube. The fourteenth tube 154 is a readily and commercially available square metal tube. The fifteenth tube 155 is a readily and commercially available square metal tube. The sixteenth tube 156 is a readily and commercially available square metal tube. The seventeenth tube 157 is a readily and commercially available square metal tube. The use of square aluminum tubes is preferred.

The first tube 141 is further defined with a first end 161 and a second end 162. The second tube 142 is further defined with a third end 163 and a fourth end 164. The third tube 143 is further defined with a fifth end 165 and a sixth end 166. The fourth tube 144 is further defined with a seventh end 167 and an eighth end 168. The fifth tube 145 is further defined with a ninth end 169 and a tenth end 170. The sixth tube 146 is further defined with an eleventh end 171 and a twelfth end 172. The seventh tube 147 is further defined with a thirteenth end 173 and a fourteenth end 174. The eighth tube 148 is further defined with a fifteenth end 175 and a sixteenth end 176. The ninth tube 149 is further defined with a seventeenth end 177 and an eighteenth end 178. The tenth tube 150 is further defined with a nineteenth end 179 and a twentieth end 180. The eleventh tube 151 is further defined with a twenty first end 181 and a twenty second end 182. The twelfth tube 152 is further defined with a twenty third end 183 and a twenty fourth end 184. The thirteenth tube 153 is further defined with a twenty fifth end 185 and a twenty sixth end 186. The fourteenth tube 154 is further defined with a twenty seventh end 187 and a twenty eighth end 188. The fifteenth tube 155 is further defined with a twenty ninth end 189 and a thirtieth end 190. The sixteenth tube 156 is further defined with a thirty first end 191 and a thirty second end 192. The seventeenth tube 157 is further defined with a thirty third end 193 and a thirty fourth end 194.

To form the first door 101, the first end 161 of the first tube 141 attaches to the tenth end 170 of the fifth tube 145 forming a perpendicular angle. The second end 162 of the first tube 141 attaches to the third end 163 of the second tube 142 forming a perpendicular angle. The fourth end 164 of the second tube 142 attaches to the fifth end 165 of the third tube 143 forming a perpendicular angle. The sixth end 166 of the third tube 143 attaches to the seventh end 167 of the fourth tube 144 forming a non-perpendicular angle. The eighth end 168 of the fourth tube 144 attaches to the ninth end 169 of the fifth tube 145 forming a non-perpendicular angle.

To form the second door 102, the eleventh end 171 of the sixth tube 146 attaches to the twentieth end 180 of the tenth tube 150 forming a perpendicular angle. The twelfth end 172 of the sixth tube 146 attaches to the thirteenth end 173 of the seventh tube 147 forming a perpendicular angle. The fourteenth end 174 of the seventh tube 147 attaches to the fifteenth end 175 of the eighth tube 148 forming a non-perpendicular angle. The sixteenth end 176 of the eighth tube 148 attaches to the seventeenth end 177 of the ninth tube 149 forming a non-perpendicular angle. The eighteenth end 178 of the ninth tube 149 attaches to the nineteenth end 179 of the tenth tube 150 forming a perpendicular angle.

The master panel 103 is assembled by connecting the first sidelight 111 to the second sidelight 112 using the master transom 114 and the seventeenth tube 157. To form the first sidelight 111, the twenty first end 181 of the eleventh tube 151 attaches to the twenty sixth end 186 of the thirteenth tube 153 forming a perpendicular angle. The twenty second end 182 of the twelfth tube 152 attaches to the twenty third end 183 of the twelfth tube 152 forming a perpendicular angle. The first transom 115 attaches the twenty fourth end 184 of the twelfth tube 152 to the twenty fifth end 185 of the thirteenth tube 153 such that the twelfth tube 152 and the thirteenth tube 153 are parallel. To form the second sidelight 112, the twenty seventh end 187 of the fourteenth tube 154 attaches to the thirty second end 192 of the sixteenth tube 156 forming a perpendicular angle. The twenty eighth end 188 of the fourteenth tube 154 attaches to the twenty ninth end 189 of the fifteenth tube 155 forming a perpendicular angle. The second transom 116 attaches the thirtieth end 190 of the fifteenth tube 155 to the thirty first end 191 of the sixteenth tube 156 such that the fifteenth tube 155 and the sixteenth tube 156 are parallel. To complete the master panel 103, the thirty third end 193 of the seventeenth tube 157 attaches to the third end 183 of the twelfth tube 152. The thirty fourth end 194 of the seventeenth tube 157 attaches to thirty second end 192 of the sixteenth tube 156.

As shown most clearly in FIG. 1, the first door 101 attaches to the assembled master panel 103 by attaching the fifth tube 145 to the twelfth tube 152 using the first hinge 121. The second door 102 attaches to the assembled master panel 103 by attaching the seventh tube 147 to the sixteenth tube 156 using the second hinge 122. In the first potential embodiment of the disclosure, the first hinge 121 and the second hinge 122 are readily and commercially available piano hinges.

To use the invention 100, the invention 100 is mounted on the window well 131 such that the first door 101 and the second door 102 swing away from the window well 131. The invention 100 secures to the window well 131 using commercially available hardware.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two-cylinder or like structures share the same line they are said to be aligned. When the center axes of two-cylinder like structures do not share the same line they are said to be offset.

Hinge: As used in this disclosure, a hinge is a device that permits the turning, rotating, or pivoting of a first object relative to a second object.

Latch: As used in this disclosure, a latch is a fastening or locking mechanism. The use of the term latch does not necessarily but often implies the insertion of an object into a notch or cavity.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Perimeter: As used in this disclosure, a perimeter is one or more curved or straight lines that bounds an enclosed area on a plane or surface. The perimeter of a circle is commonly referred to as a circumference.

Piano Hinge: As used in this disclosure, a piano hinge is: 1) a hinge that is longer than 12 inches; and 2) has a pin that runs fully along at least one of the surfaces that the piano hinge is attached to.

Pivot: As used in this disclosure, a pivot is a rod or shaft around which an object rotates or swings.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines Tube: As used in this disclosure, a tube is a hollow device that is used for transporting liquids and gasses. The line that connects the center of the first base of the tube to the center of the second base of the tube is referred to as the center axis or the centerline of the tube. In this disclosure, the terms inner diameter of a pipe and outer diameter are used as they would be used by those skilled in the plumbing arts.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An accessory for a light shaft comprising:

a first door, a second door, a master panel, and a locking latch;

wherein the first door and the second door are mounted on the master panel;

wherein the locking latch secures the first door and the second door in a closed position;

wherein the accessory for a light shaft is an accessory adapted for use with a window well;

wherein the accessory for a light shaft is a cover that is placed on top of the window well;

wherein the accessory for a light shaft is fitted with a first door and a second door that allows access into the window well for maintenance purposes;

wherein the first door and the second door are secured with the locking latch;

wherein the first door comprises a first tube, a second tube, a third tube, a fourth tube, a fifth tube, a first hinge, and a first screen mesh;

wherein the first tube, the second tube, the third tube, the fourth tube, and the fifth tube are assembled into a first rectilinear frame;

wherein the first hinge is attached to the fifth tube;

wherein the first hinge attaches to the fifth tube;

wherein the first door is covered with the first screen mesh;

the second door comprises a sixth tube, a seventh tube, an eighth tube, a ninth tube, a tenth tube, a second hinge, and a second screen mesh;

wherein the sixth tube, the seventh tube, an eighth tube, the ninth tube, and the tenth tube are assembled into a second rectilinear frame;

wherein the second hinge attaches to the seventh tube;

wherein the second hinge attaches to the master panel wherein the second door is covered with a second screen mesh.

2. The accessory for a light shaft according to claim 1 wherein the master panel comprises a first sidelight, a second sidelight and a door panel, and a master transom;

wherein the master transom is a metal plate;

wherein the master transom further comprises a first transom, a second transom, and a door transom;

wherein the first sidelight and the second sidelight are attached to the door panel.

3. The accessory for a light shaft according to claim 2 wherein the first sidelight further comprises an eleventh tube, a twelfth tube, a thirteenth tube, and the first transom;

wherein the second sidelight further comprises a fourteenth tube, a fifteenth tube, a sixteenth tube, and the second transom;

wherein the door panel further comprises a seventeenth tube and the door transom.

4. The accessory for a light shaft according to claim 3 wherein the locking latch comprises a latch arm, a latch shaft, a latch post, a release bar, a release handle, a release spring, a lock pin, and a lock pin hole;

wherein the latch arm attaches to the sixth tube of the second door on the latch shaft such that the latch arm rotates using the latch shaft as a pivot;

wherein the latch arm further comprises a notch;

wherein the notch encloses the latch post;

wherein the latch post is a cylindrical shaft that is attached to the seventeenth tube of the master panel such that when the latch arm closes the latch post the second door is locked in a closed position;

wherein the release handle is a structure that is mounted on the seventeenth tube of the master panel such that the release handle can be rotated around a pivot;

wherein the release bar is attached to the release handle such that when the release handle is rotated the release bar will rotate in a manner that pushes the latch arm may from the latch post thereby allowing the second door to open by rotating away from the window well;

wherein the release handle is further fitted with the release spring.

5. The accessory for a light shaft according to claim 4 wherein the second tube of the first door is further fitted with a plurality of interlocking panels;

wherein the plurality of interlocking panels to interact with tenth tube of the second door such that when the second door is locked in position with the locking latch, the plurality of interlocking panels prevent the first door from opening.

6. The accessory for a light shaft according to claim 5 wherein the first tube is a square metal tube;

wherein the second tube is a square metal tube;

wherein the third tube is a square metal tube;

wherein the fourth tube is a square metal tube;

wherein the fifth tube is a square metal tube;

wherein the sixth tube is a square metal tube;

wherein the seventh tube is a square metal tube;

wherein the eighth tube is a square metal tube;

wherein the ninth tube is a square metal tube;

wherein the tenth tube is a square metal tube;

wherein the eleventh tube is a square metal tube;

wherein the twelfth tube is a square metal tube;

wherein the thirteenth tube is a square metal tube;

wherein the fourteenth tube is a square metal tube;

wherein the fifteenth tube is a square metal tube;

wherein the sixteenth tube is a square metal tube;

wherein the seventeenth tube is a square metal tube;

wherein the first tube is further defined with a first end and a second end;

wherein the second tube is further defined with a third end and a fourth end;

wherein the third tube is further defined with a fifth end and a sixth end;

wherein the fourth tube is further defined with a seventh end and an eighth end;

wherein the fifth tube is further defined with a ninth end and a tenth end;

wherein the sixth tube is further defined with an eleventh end and a twelfth end;

wherein the seventh tube is further defined with a thirteenth end and a fourteenth end;

wherein the eighth tube is further defined with a fifteenth end and a sixteenth end;

wherein the ninth tube is further defined with a seventeenth end and an eighteenth end;

wherein the tenth tube is further defined with a nineteenth end and a twentieth end;

wherein the eleventh tube is further defined with a twenty first end and a twenty second end;

wherein the twelfth tube is further defined with a twenty third end and a twenty fourth end;

wherein the thirteenth tube is further defined with a twenty fifth end and a twenty sixth end;

wherein the fourteenth tube is further defined with a twenty seventh end and a twenty eighth end;

wherein the fifteenth tube is further defined with a twenty ninth end and a thirtieth end;

wherein the sixteenth tube is further defined with a thirty first end and a thirty second end;

wherein the seventeenth tube is further defined with a thirty third end and a thirty fourth end.

7. The accessory for a light shaft according to claim 6 wherein the first end of the first tube attaches to the tenth end of the fifth tube forming a perpendicular angle;

wherein the second end of the first tube attaches to the third end of the second tube forming a perpendicular angle;

wherein the fourth end of the second tube attaches to the fifth end of the third tube forming a perpendicular angle;

wherein the sixth end of the third tube attaches to the seventh end of the fourth tube forming a non-perpendicular angle;

wherein the eighth end of the fourth tube attaches to the ninth end of the fifth tube forming a non-perpendicular angle.

8. The accessory for a light shaft according to claim 7 wherein the eleventh end of the sixth tube attaches to the twentieth end of the tenth tube forming a perpendicular angle;

wherein the twelfth end of the sixth tube attaches to the thirteenth end of the seventh tube forming a perpendicular angle;

wherein the fourteenth end of the seventh tube attaches to the fifteenth end of the eighth tube forming a non-perpendicular angle;

wherein the sixteenth end of the eighth tube attaches to the seventeenth end of the ninth tube forming a non-perpendicular angle;

wherein the eighteenth end of the ninth tube attaches to the nineteenth end of the tenth tube forming a perpendicular angle.

9. The accessory for a light shaft according to claim 8 wherein the master panel is assembled by connecting the first sidelight to the second sidelight using the master transom and the seventeenth tube.

10. The accessory for a light shaft according to claim 9 wherein the twenty first end of the eleventh tube attaches to the twenty sixth end of the thirteenth tube forming a perpendicular angle;

wherein the twenty second end of the twelfth tube attaches to the twenty third end of the twelfth tube forming a perpendicular angle;

wherein the first transom attaches the twenty fourth end of the twelfth tube to the twenty fifth end of the thirteenth tube such that the twelfth tube and the thirteenth tube are parallel.

11. The accessory for a light shaft according to claim 10 wherein the twenty seventh end of the fourteenth tube attaches to the thirty second end of the sixteenth tube forming a perpendicular angle;

wherein the twenty eighth end of the fourteenth tube attaches to the twenty ninth end of the fifteenth tube forming a perpendicular angle;

wherein the second transom attaches the thirtieth end of the fifteenth tube to the thirty first end of the sixteenth tube such that the fifteenth tube and the sixteenth tube are parallel.

12. The accessory for a light shaft according to claim 10 wherein the thirty third end of the seventeenth tube attaches to the third end of the twelfth tube;

wherein the thirty fourth end of the seventeenth tube attaches to thirty second end of the sixteenth tube.

13. The accessory for a light shaft according to claim 12 wherein the first door attaches to the assembled master panel by attaching the fifth tube to the twelfth tube using the first hinge;

wherein the second door attaches to the assembled master panel by attaching the seventh tube to the sixteenth tube using the second hinge.

14. The accessory for a light shaft according to claim 13 wherein when installed on the master panel, the first door and the second door are mirror images of each other;

wherein when installed on the master panel, the first sidelight and the second sidelight are mirror images of each other.

15. The accessory for a light shaft according to claim 3 wherein the first tube is further defined with a first end and a second end;

wherein the second tube is further defined with a third end and a fourth end;

wherein the third tube is further defined with a fifth end and a sixth end;

wherein the fourth tube is further defined with a seventh end and an eighth end;

wherein the fifth tube is further defined with a ninth end and a tenth end;

wherein the sixth tube is further defined with an eleventh end and a twelfth end;

wherein the seventh tube is further defined with a thirteenth end and a fourteenth end;

wherein the eighth tube is further defined with a fifteenth end and a sixteenth end;

wherein the ninth tube is further defined with a seventeenth end and an eighteenth end;

wherein the tenth tube is further defined with a nineteenth end and a twentieth end;

wherein the eleventh tube is further defined with a twenty first end and a twenty second end;

wherein the twelfth tube is further defined with a twenty third end and a twenty fourth end;

wherein the thirteenth tube is further defined with a twenty fifth end and a twenty sixth end;

wherein the fourteenth tube is further defined with a twenty seventh end and a twenty eighth end;

wherein the fifteenth tube is further defined with a twenty ninth end and a thirtieth end;

wherein the sixteenth tube is further defined with a thirty first end and a thirty second end;

wherein the seventeenth tube is further defined with a thirty third end and a thirty fourth end;

wherein the first end of the first tube attaches to the tenth end of the fifth tube forming a perpendicular angle;

wherein the second end of the first tube attaches to the third end of the second tube forming a perpendicular angle;

wherein the fourth end of the second tube attaches to the fifth end of the third tube forming a perpendicular angle;

wherein the sixth end of the third tube attaches to the seventh end of the fourth tube forming a non-perpendicular angle;

wherein the eighth end of the fourth tube attaches to the ninth end of the fifth tube forming a non-perpendicular angle;

wherein the eleventh end of the sixth tube attaches to the twentieth end of the tenth tube forming a perpendicular angle;

wherein the twelfth end of the sixth tube attaches to the thirteenth end of the seventh tube forming a perpendicular angle;

wherein the fourteenth end of the seventh tube attaches to the fifteenth end of the eighth tube forming a non-perpendicular angle;

wherein the sixteenth end of the eighth tube attaches to the seventeenth end of the ninth tube forming a non-perpendicular angle;

wherein the eighteenth end of the ninth tube attaches to the nineteenth end of the tenth tube forming a perpendicular angle.

16. The accessory for a light shaft according to claim 15 wherein the master panel is assembled by connecting the first sidelight to the second sidelight using the master transom and the seventeenth tube;

wherein the twenty first end of the eleventh tube attaches to the twenty sixth end of the thirteenth tube forming a perpendicular angle;

wherein the twenty second end of the twelfth tube attaches to the twenty third end of the twelfth tube forming a perpendicular angle;

wherein the first transom attaches the twenty fourth end of the twelfth tube to the twenty fifth end of the thirteenth tube such that the twelfth tube and the thirteenth tube are parallel;

wherein the twenty seventh end of the fourteenth tube attaches to the thirty second end of the sixteenth tube forming a perpendicular angle;

wherein the twenty eighth end of the fourteenth tube attaches to the twenty ninth end of the fifteenth tube forming a perpendicular angle;

wherein the second transom attaches the thirtieth end of the fifteenth tube to the thirty first end of the sixteenth tube such that the fifteenth tube and the sixteenth tube are parallel;

wherein the thirty third end of the seventeenth tube attaches to the third end of the twelfth tube;

wherein the thirty fourth end of the seventeenth tube attaches to thirty second end of the sixteenth tube;

wherein the first door attaches to the assembled master panel by attaching the fifth tube to the twelfth tube using the first hinge;

wherein the second door attaches to the assembled master panel by attaching the seventh tube to the sixteenth tube using the second hinge.

17. The accessory for a light shaft according to claim 16 wherein when installed on the master panel, the first door and the second door are mirror images of each other;

wherein when installed on the master panel, the first sidelight and the second sidelight are mirror images of each other.

18. The accessory for a light shaft according to claim 17 wherein the locking latch comprises a latch arm, a latch shaft, a latch post, a release bar, a release handle, a release spring, a lock pin, and a lock pin hole;

wherein the latch arm attaches to the sixth tube of the second door on the latch shaft such that the latch arm rotates using the latch shaft as a pivot;

wherein the latch arm further comprises a notch;

wherein the notch encloses the latch post;

wherein the latch post is a cylindrical shaft that is attached to the seventeenth tube of the master panel such that when the latch arm closes the latch post the second door is locked in a closed position;

wherein the release handle is a structure that is mounted on the seventeenth tube of the master panel such that the release handle can be rotated around a pivot;

wherein the release bar is attached to the release handle such that when the release handle is rotated the release bar will rotate in a manner that pushes the latch arm may from the latch post thereby allowing the second door to open by rotating away from the window well;

wherein the release handle is further fitted with the release spring.

19. The accessory for a light shaft according to claim 18 wherein the second tube of the first door is further fitted with a plurality of interlocking panels;

wherein the plurality of interlocking panels to interact with tenth tube of the second door such that when the second door is locked in position with the locking latch, the plurality of interlocking panels prevent the first door from opening.

* * * * *